US010080978B2

(12) United States Patent
Tebbe et al.

(10) Patent No.: US 10,080,978 B2
(45) Date of Patent: Sep. 25, 2018

(54) EDUCATIONAL ILLUMINATION STACKER

(71) Applicant: Munchkin, Inc., Van Nuys, CA (US)

(72) Inventors: Mark Gerard Tebbe, Ventura, CA (US); Steven Bryan Dunn, Beverly Hills, CA (US); Mark Hatherill, Beverly Hills, CA (US); Kevin Douglas Johnson, Tarzana, CA (US); Richard Ernest Scott, Jr., Hermosa Beach, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 15/417,173

(22) Filed: Jan. 26, 2017

(65) Prior Publication Data

US 2017/0209803 A1 Jul. 27, 2017

Related U.S. Application Data

(60) Provisional application No. 62/287,321, filed on Jan. 26, 2016.

(51) Int. Cl.

| | |
|---|---|
| ***A63H 33/28*** | (2006.01) |
| ***A63F 9/00*** | (2006.01) |
| ***A63H 33/22*** | (2006.01) |
| ***A63H 33/04*** | (2006.01) |
| ***A63H 33/26*** | (2006.01) |
| ***A63F 9/24*** | (2006.01) |

(52) U.S. Cl.

CPC ..... *A63H 33/22* (2013.01); *A63F 9/0073* (2013.01); *A63F 9/24* (2013.01); *A63H 33/042* (2013.01); *A63H 33/26* (2013.01); *A63F 2009/247* (2013.01); *A63F 2009/2442* (2013.01); *A63F 2009/2452* (2013.01); *A63F 2009/2476* (2013.01)

(58) Field of Classification Search

CPC . A63H 3/00; A63H 3/006; A63H 3/28; A63H 3/36; A63H 33/00; A63H 33/006; A63H 33/22; A63H 5/00

USPC ..... 446/69, 117, 175, 219, 484

See application file for complete search history.

(56) References Cited

U.S. PATENT DOCUMENTS

| | | | | |
|---|---|---|---|---|
| D321,022 | S * | 10/1991 | Mariol | D21/623 |
| D366,286 | S * | 1/1996 | Kino | D21/471 |
| 6,755,713 | B1 * | 6/2004 | Weber | A63H 5/00 446/143 |
| 7,857,624 | B2 * | 12/2010 | Davis | G09B 1/02 273/156 |
| 8,814,625 | B1 * | 8/2014 | Long | A63H 33/006 446/175 |

* cited by examiner

*Primary Examiner* — Kien Nguyen

(74) *Attorney, Agent, or Firm* — Robert Z. Evora, Esq.; Christian Lek

(57) ABSTRACT

An illumination stacker game is described having audiovisual signals for placing rings of different colors onto a central core. Upon placement, sensors determine which ring has been placed and provide audiovisual feedback as to whether the ring placed is the one which was requested in the game sequence. Different levels of difficulties and different audiovisual modes of communication are involved including multiple languages.

15 Claims, 15 Drawing Sheets

EDUCATIONAL ILLUMINATION STACKER

CROSS REFERENCE TO RELATED APPLICATIONS

This application claims priority to U.S. Provisional Patent Application Ser. No. 62/287,321, filed Jan. 26, 2016; the content of which is hereby incorporated by reference herein in its entirety into this disclosure.

TECHNICAL FIELD

The subject disclosure relates generally to teaching devices. In particular, the subject disclosure relates to sensory teaching devices and methods.

BACKGROUND

One of the most popular and recognizable games for toddlers is the stacking game where a toddler has to stack a series of blocks, rings, or other shapes to create a small tower. The game provides a mental exercise in decision-making and coordination as various blocks need to be stacked in just the right way to create a balanced tower that does not fall before the last piece is placed. Often a child is pleased with his efforts when the entire tower remains standing at the end of the game.

SUMMARY OF THE SUBJECT DISCLOSURE

The present subject disclosure provides a novel stacking toy that brings a new level of learning for a toddler with lights, music, and the verbalization of colors in multiple languages. The concepts embodied in the present subject disclosure allow the toddler to develop fine motor skills and problem solving while having fun. This game of stacking rings while learning colors allows immediate feedback with pulsing lights indicating correct color ring placement along with a positive chime sound. The colors can be verbalized in multiple languages. Various difficulty levels may also be selected.

This product takes on the play pattern of the traditional stacking toy with the enhanced features of sound, voice and lights, such as LED's. The product can have many modes: easy, intermediate and advanced; musical sound effects; spoken words in multiple languages, e.g., English, Spanish, Mandarin; and lights. It can have a try-me button that will activate sound, voice and lighting effects at retail to highlight the enhanced feature set.

To properly assemble all rings they must be placed with the largest ring at the bottom. The next ring to be assembled is the next largest ring and so forth, until the smallest ring is placed at the top. Any of the rings can be placed right side up or upside down, due to the conical shape of the core each ring will have a specific location where to stop. Any of the rings can be assembled onto the base component at any time. However, they must be assembled in the proper orientation onto the base to properly complete the gameplay.

In one exemplary embodiment, the present subject matter is a feedback stacker. The feedback stacker includes a plurality of rings; a base; a cylindrical core extending in a perpendicular direction away from the base; a plurality of segments on the core, each segment including a sensor for detecting the presence of a corresponding ring; and an audiovisual alert signal that signifies whether a correct ring is positioned on the cylindrical core in response to an audiovisual request signal.

In another exemplary embodiment, the present subject matter is a feedback stacker. The feedback stacker includes a plurality of rings having center apertures of different diameters; a base; a cylindrical core extending in a perpendicular direction away from the base; a plurality of segments on the core, each segment including a different colored visual indicator, and a sensor for detecting the presence of a corresponding ring; and an audiovisual alert signal that signifies whether a correct ring is positioned on the cylindrical core in response to an audiovisual request signal.

In yet another exemplary embodiment, the present subject matter is a method of playing stacker. The method includes providing a base with a cylindrical core having sensors thereon to determine rings placed thereon; signaling a first audiovisual request signal indicating a first requested color; receiving a first ring on the cylindrical core; determining if the first ring has a color that matches the first requested color; and providing an alert that indicates whether the first ring matches the first requested color.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present subject disclosure will now be described in greater detail with reference to the figures.

Figure 1:
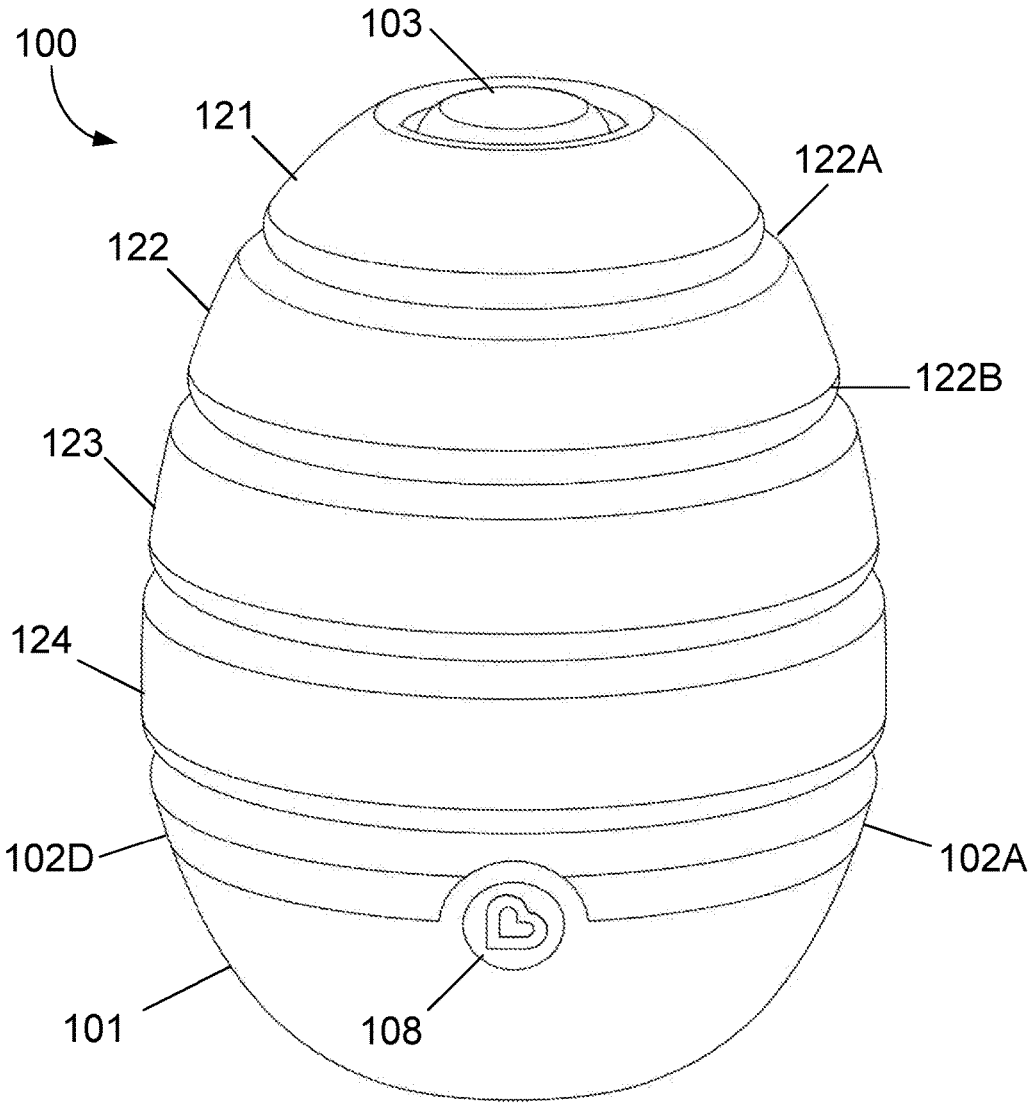
FIG. 1 illustrates a perspective view of an educational illumination stacker, according to an exemplary embodiment of the present subject disclosure.

FIGS. 1-2 illustrate an exemplary educational illumination stacker device 100 in the general shape of a large egg. Any other shape is also possible, as long as the shape and accessories operate as described herein. The stacker 100 has a round base 101 and a central core 103 with a cylindrical body having a larger diameter close to its connection from the base 101 and a continually narrowing diameter as it projects away from the base 101. Stacked atop the core 103 are a number of rings. As shown in the exemplary embodiments, four rings are used. However, any number is possible. Rings 121, 122, 123, and 124 all have a central aperture of differing diameters and are designed to fit with the portion of the core which is sized specifically to maintain that particular ring, as will be described in more detail later. Each ring 121, 122, 123, and 124 has its own unique shape and serve to combine together to form an egg shaped exterior contour, as shown in FIG. 1.

Figures 2A, 2B:
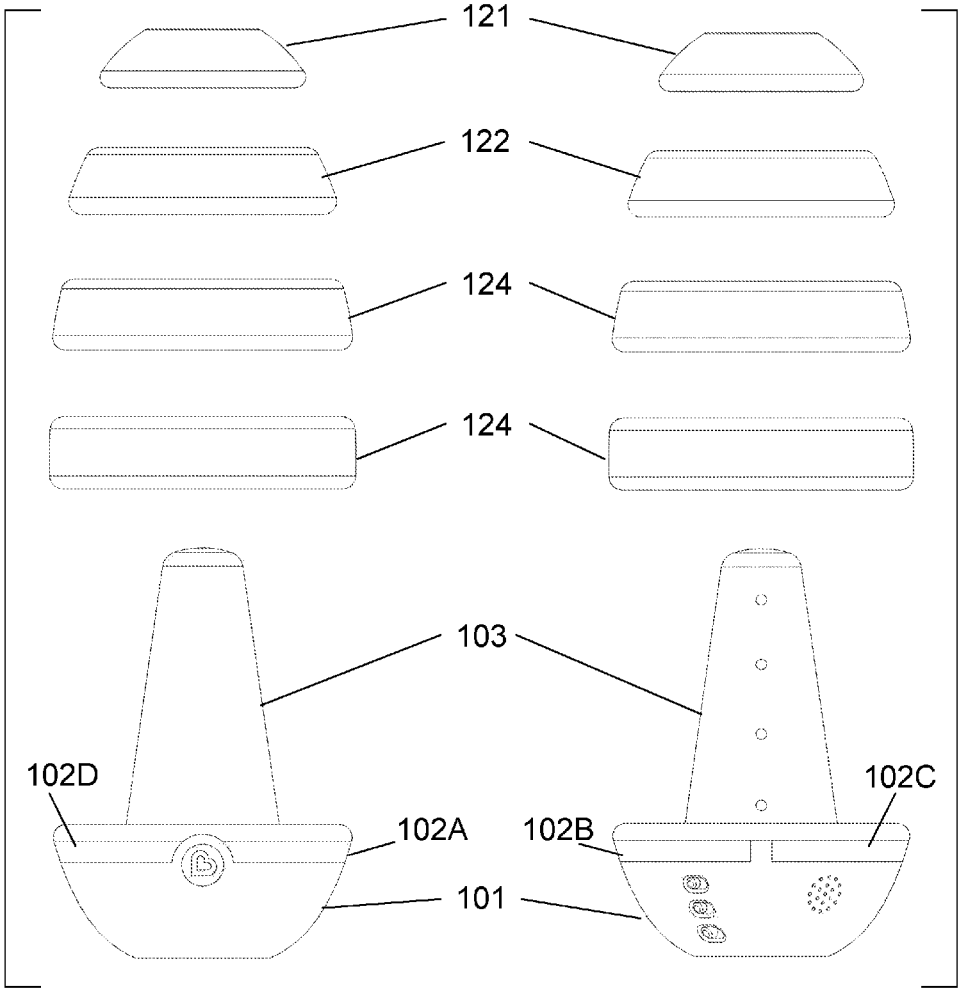
FIGS. 2A-2B illustrate exploded front and back views of an educational illumination stacker with rings, according to an exemplary embodiment of the present subject disclosure.
Figures 3A, 3B:
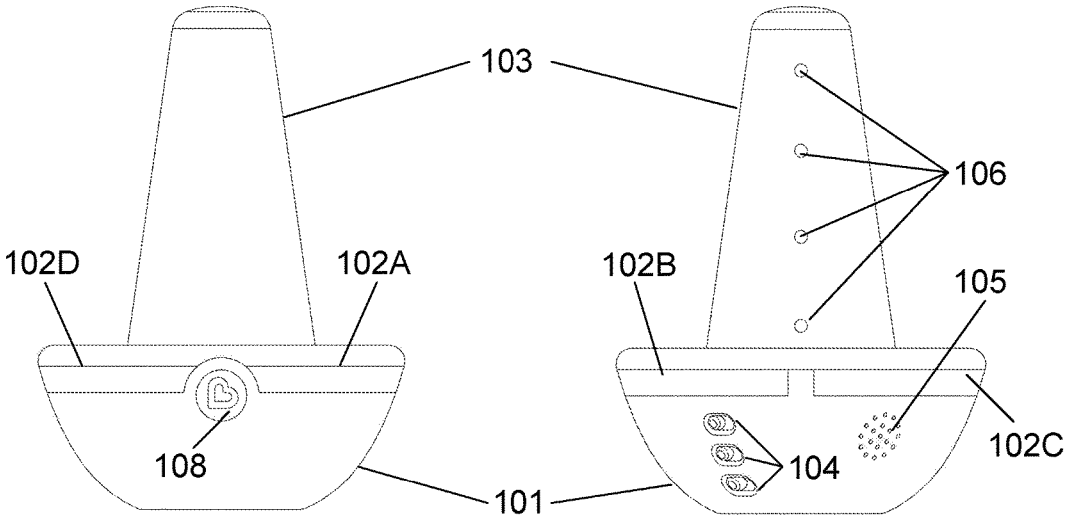
FIGS. 3A-3B illustrate front and back views of an educational illumination stacker with rings removed, according to an exemplary embodiment of the present subject disclosure.
Figures 4A, 4B:
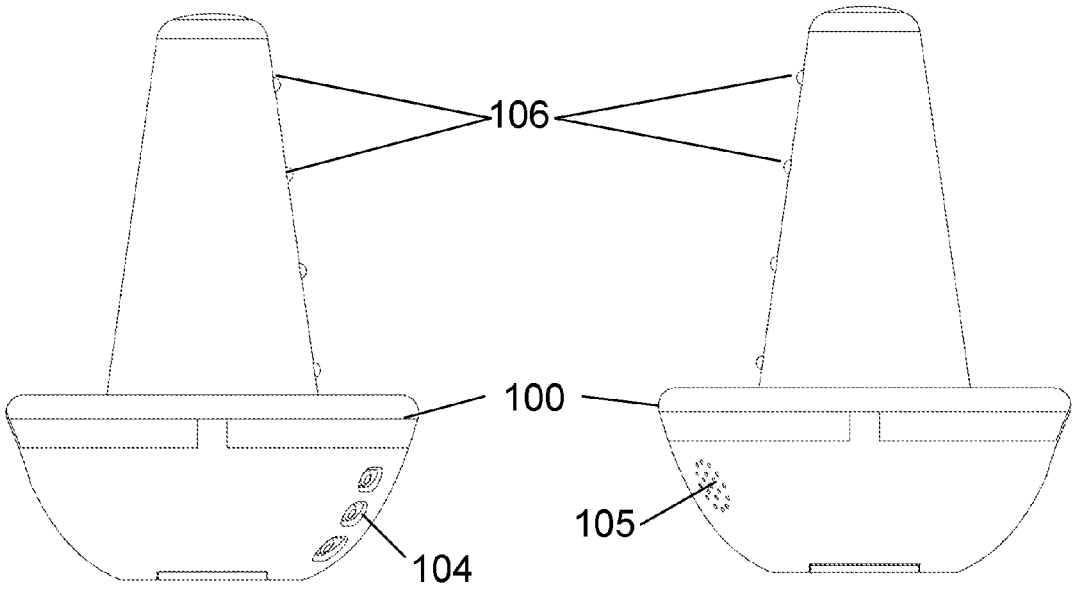
FIGS. 4A-4B illustrate right and left side views of an educational illumination stacker with rings removed, according to an exemplary embodiment of the present subject disclosure.

The exterior wall of each ring increases in angle with each subsequent ring until it is substantially perpendicular to the axis indicating the width of the ring. For example, as shown in FIG. 2A, ring 121 has an exterior wall surface with a slope that is a given angle in degrees with respect to a line indicating the width of the ring 121. Each subsequent ring, 122, 123, and 124 has an outer surface with a greater angle than the ring above it. The exterior surface of ring 124 has a substantially perpendicular angle with respect to the width of the ring 124 as seen in FIG. 2A. In other words, the exterior wall angle of ring 124 is greater than ring 123 is greater than ring 122 is greater than ring 121. This gradual decreasing angle on the exterior surface from ring 124 to ring 121 helps to provide an overall egg shape when all of the rings are properly placed on the central core 103, as shown in FIG. 1.

Further, each ring (for example, ring 122, as shown in FIG. 1) has one or more beveled edges 122A and 122B which correspond to the sides facing the adjacent rings, or base 101. The beveled edges 122A and 122B allow for easier gripping and separation of the ring 122 when the ring 122 is stacked on the core 103. The beveled edged shown on all rings 121, 122, 123, and 124 in FIG. 1 (and throughout) make it easier to separate the rings from each other when taking them off of or putting them on to the core 103. Also, the beveled edges prevent sharp edges which could harm a child.

Four quarter lights 102A, 1026, 102C, and 102D are shown encircling the top outer circumference of the base 101. The quarter lights 102A, 102*b*, 102C, and 102D are used to signal visual communication to the user in various games which are programmed into the device 100. The quarter lights are generally labeled as 102 and may be any number including more or less than four. A "try me" button 108 may be included on the front of the device 100 and may be used to initiate a pre-programmed series of lights, sounds or verbal communication to the user. The button 108 may also have a light backing to add to the enhanced display of lights to attract a possible purchaser. Such a button 108 is especially helpful for packaging of the device 100 and allowing a potential purchaser a facilitated access to the try me button 108 while the device 100 is still within its packaging at, for example, a store shelf. After the first time use of the "try me" button, the button 108 may become an on/off button to control the activation of the device 100.

FIGS. 3A-3B and 4A-4B illustrate front (3A), back (3B), right (4A), and left (4B) side views of the device 100 without rings. As shown, the base 101 and core 103 form a stable central region of the device 100. Command buttons 104 are placed on a back side (FIG. 3B) of the device 100, and are used to control various commands, such as on/off, volume, language, difficulty, etc. Speaker 105 projects sounds, music, and voice for the user. Sensors 106 are used to determine whether a particular ring has been placed in a particular position on the core 103. Each ring has its own sensor, as will be described in more detail below.

The series of command/option buttons 104 can have multiple functions. One button can be a mode switch, which is a 3-position switch that allows the user to select easy, intermediate or advanced game mode. Another button can be a language switch, which is a 4-position switch that will allow the user to select from Off, English, Spanish, French, Mandarin, etc. Another switch may be a volume switch, which is a 3-position switch that will allow the user to select from Off, Low and High. Other switches and functions are also possible and may be added without detracting from the teachings of the present subject disclosure.

Figure 5A:
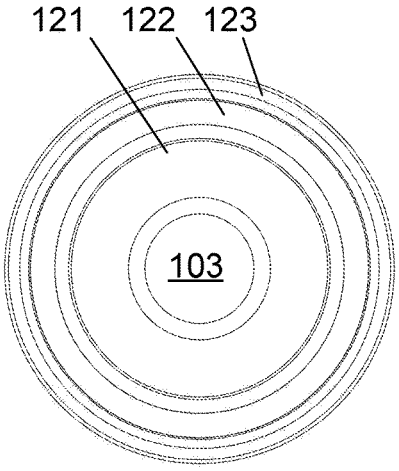
FIGS. 5A-5B illustrate top and bottom views of an educational illumination stacker with rings, according to an exemplary embodiment of the present subject disclosure.
Figure 5B:
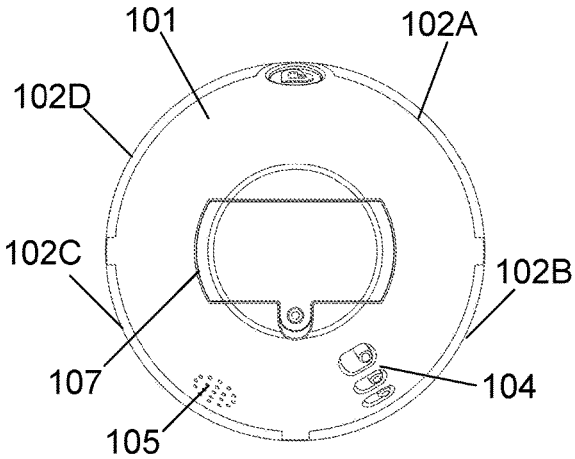

FIGS. 5A-5B illustrate top (5A) and bottom (5B) views of the device 100. The top view in FIG. 5A shows the concentric ring positions of rings 121, 122, and 123 around the core 103. The bottom view in FIG. 5B shows the base 101 encircled by the quarter lights 102A, 102B, 102C, and 102D. Command buttons 104 and speaker 105 are also visible. Battery compartment door 107 allows access to the interior electronics of device 100, including access to the battery compartment to replace batteries as needed.

Figure 6A:
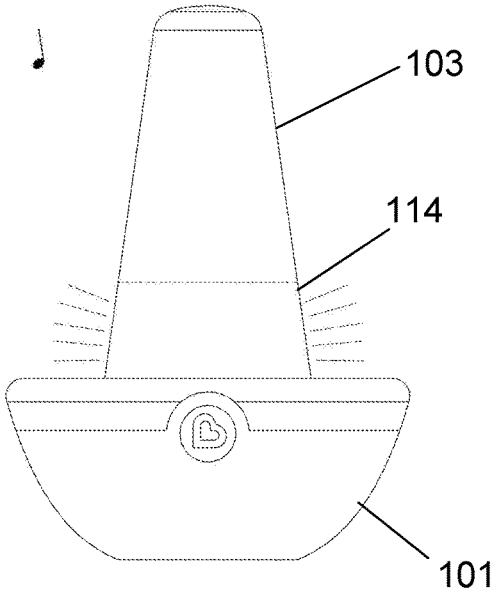
FIGS. 6A-6B illustrate front and back views of an educational illumination stacker with rings removed and visual alerts, according to an exemplary embodiment of the present subject disclosure.
Figure 6B:
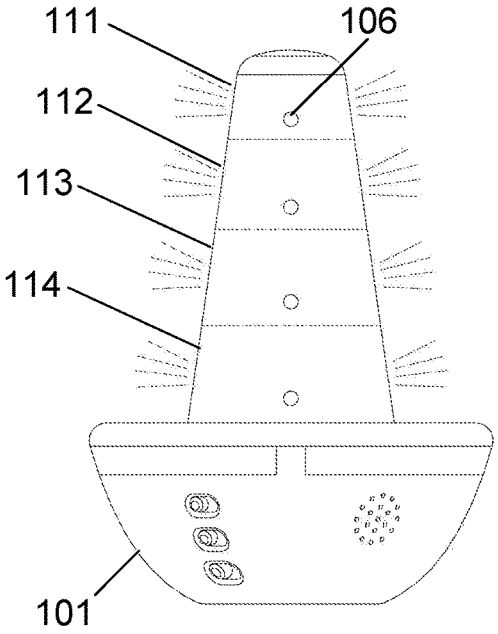

FIGS. 6A-6B illustrate front (6A) and back (6B) views of the device 100 with rings removed. As shown in FIG. 6A, the core 103 is further divided into segments which correlate to each individual ring. For example, core segment 114 may be illuminated individually. Alternatively, one or more of all four core segments 111, 112, 113, and 114 may be illuminated. Such illumination may be a flash, continuous light, and/or rhythmic lights which are flashed in correlation with a song or melody placed on the device 100. As shown in FIG. 6B, each core segment 111, 112, 113, and 114 has its own unique sensor 106, which is triggered once the specific ring (i.e., ring 121) is in place on the core 103. This indicates to the device 100 electronics that ring 121 is properly positioned over core segment 111. The sensor may be any type of sensor that detects the presence of an object, including, but not limited to, pressure and/or light sensors.

Figure 7A:
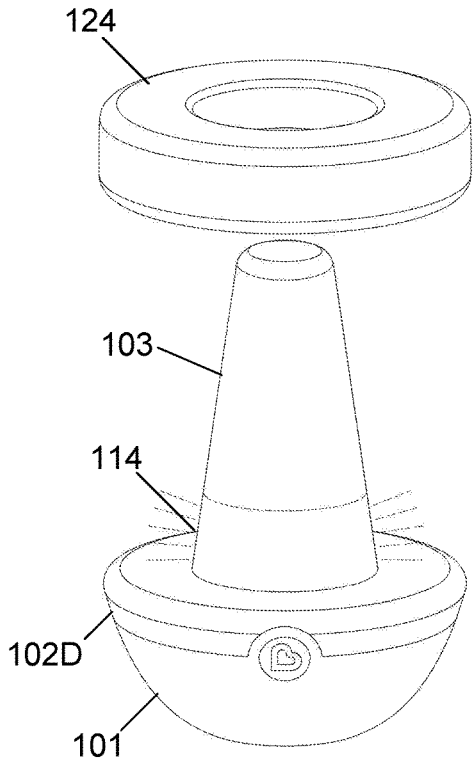
FIGS. 7A-7B illustrate front perspective views of an educational illumination stacker with visual alerts and placement of the first ring, according to an exemplary embodiment of the present subject disclosure.
Figure 7B:
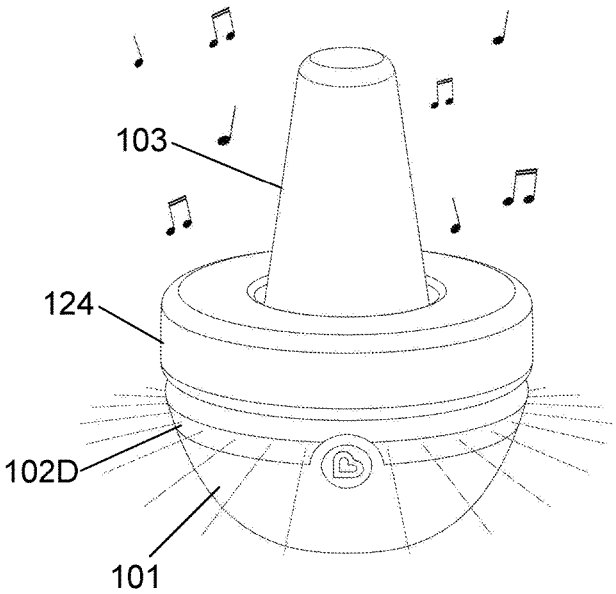

FIGS. 7A-7B illustrate a game technique wherein core segment 114 is illuminated to show a particular color (for example, blue). The illumination may be continuous and/or flashing. The speaker may, in addition to or in lieu of the visual indicator, say the word "blue" (in English, Spanish, French, Chinese, etc.) to provide an additional auditory signal to the toddler to learn the word associated with the color "blue." Additionally, the speaker 105 may project a sound which may be a note, a series of notes, or a short song until the corresponding colored ring 124 is placed on to the core 113. When the correct ring 124 is placed on the core 103, as detected by the sensor 106 adjacent to where ring 124 should be placed, a song or other audible positive confirmation is played to indicate that the correct ring 124 has been placed on the core 103.

Figure 8A:
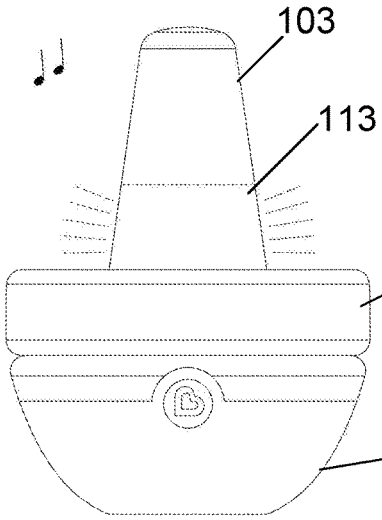
FIGS. 8A-8D illustrate side views of an educational illumination stacker with visual alerts and placement of the first, second, third, and fourth rings, according to an exemplary embodiment of the present subject disclosure.
Figure 8B:
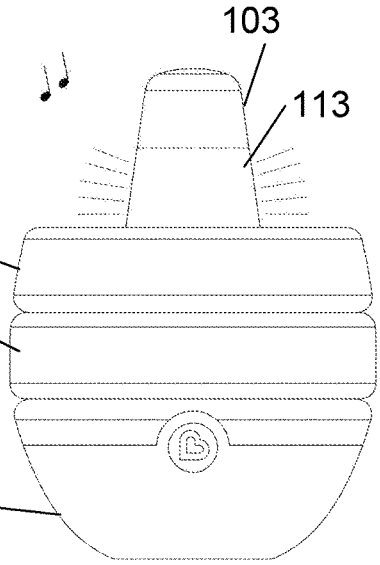
Figure 8C:
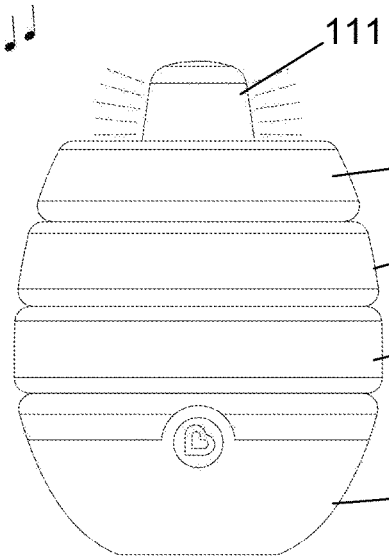
Figure 8D:
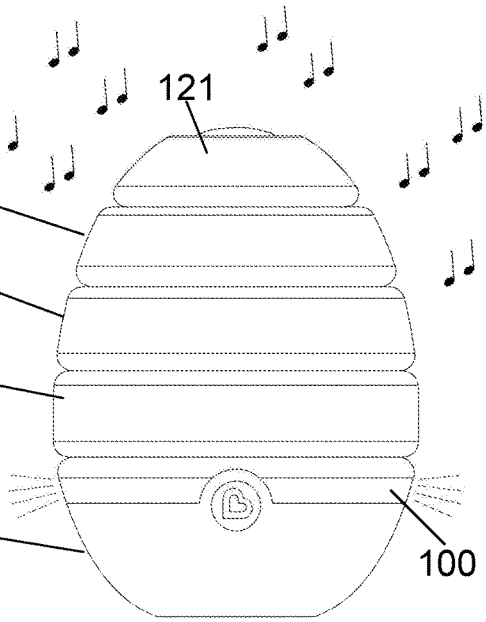

FIGS. 8A-8D illustrate a sequence of placements of rings 121, 122, 123, and 124 on to the core 103. As each individual core segment 114, 113, 112, 111 flashes in a distinct color, and optionally accompanied by an oral indication of the color (e.g., blue, pink, green, yellow), the correspondingly colored rings 224 (blue), 223 (pink), 222 (green), and 221 (yellow) are placed on the core 103. The sequence shown in FIGS. 7A, 7B, 8A, 8B, 8C, 8D illustrate placement of specifically colored and shaped rings 224, 223, 222, and 221 on to the core 103 to align with the corresponding colored and shaped core segments 114, 113, 112, and 111, respectively. Each time a ring is placed on the core, the corresponding sensor 106 detects the ring, and signals the internal processor (not shown) to proceed to the next step. The end result, as shown in FIG. 8D, is a completely stacked device 100 which plays a melody indicating success and/or produces flashing lights to indicate a successful completion of the ring stacking. Upon removal of one or more rings from FIG. 8D, the music and flashing may cease, and the game may be repeated.

Figure 9:
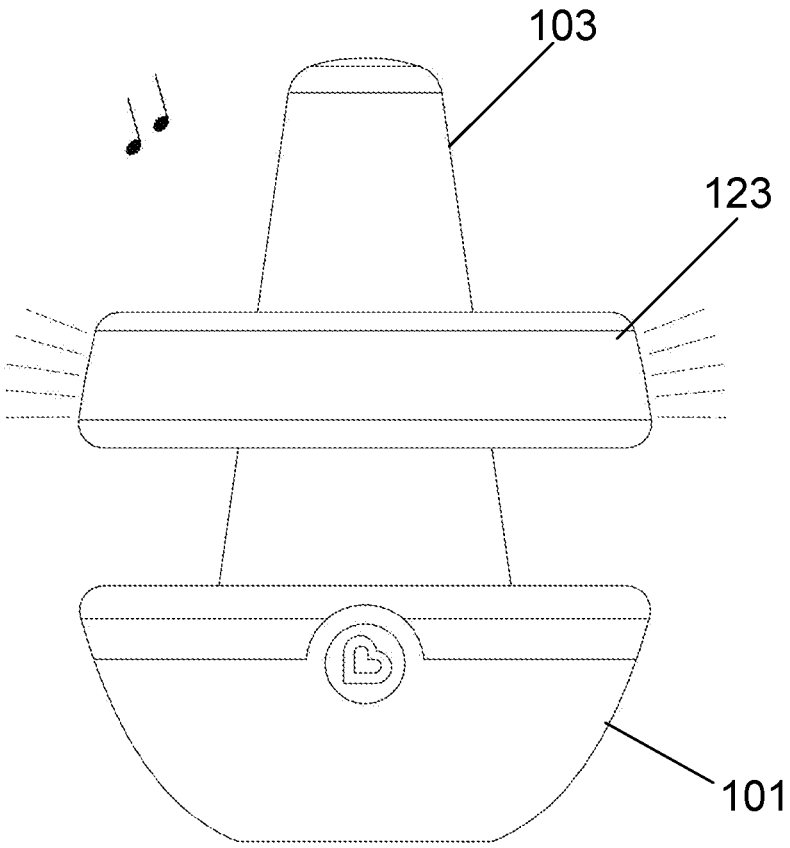
FIG. 9 illustrates a side view of an educational illumination stacker with visual alerts and placement of the second ring, according to an exemplary embodiment of the present subject disclosure.

Numerous types of games may be implemented in the device 100. FIGS. 7-8 present a standard sequential stacking game with a specific ordered sequence of colors. Many other games are also possible. For example, FIG. 9 shows a game where the device 100 indicates a color (e.g., "pink") and possibly projects the audible indicator as "pink" (and/or in other pre-set languages, or combinations thereof). The toddler then seeks and finds the pink colored ring 223 and places it on the core 103. If this is successful, then the device 100 projects a successful melody and/or flashing on the colored ring 123 to indicate success. If the wrong colored ring (for example, ring 121) is placed on the core 103 when the core segment 113 is flashing (or audible request is for "pink"), then a failure horn or other negative sound is projected indicating an unsuccessful placement involving an incorrect ring. The toddler can then learn to understand the negative sound indication and remove the ring 121 and seek to find the correct ring 123.

Figure 10:
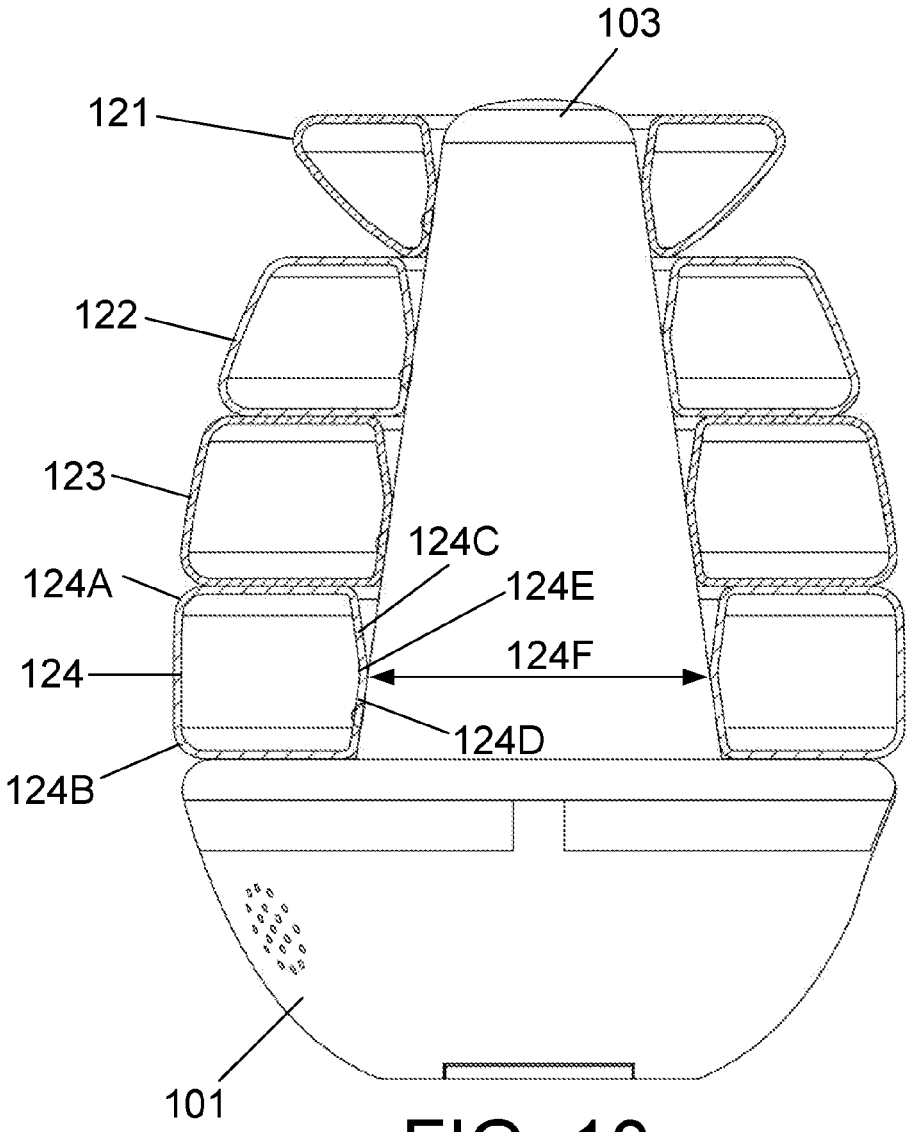
FIG. 10 illustrates a side cross sectional view of the rings of an educational illumination stacker with placement of the first through third rings in proper format and an upside down fourth ring, according to an exemplary embodiment of the present subject disclosure.

FIG. 10 shows a cross sectional view through the rings 121, 122, 123, and 124 to show their positioning with respect to core 103. As discussed above, each ring has one or more beveled edges. As shown in FIG. 10, ring 124 ("blue") has external beveled edges 124A and 124B which allow for safer and easier handling and separation of ring 124 while the ring 124 is on the core 103 and when it is not. Each ring, such as ring 124, also has an interior contact surface comprising two straight edges, 124C and 124D, which come together at a central interior point 124E.

The diameter 124F which separates the central point 124E of each circular ring is also the smallest diameter of the particular given ring. For example, the distance between the center of ring 124 and a point 124E on its inner ring edge determines the smallest radius of ring 124. This smallest diameter then in turn determines the stopping point of the ring on the core 103. For example, ring 121 may never be able to come down lower than its position on the core segment 111 because its inner ring diameter stops it from sliding further down the core 103 than the position shown in FIG. 10.

However, the unique design of the interior contact surfaces (e.g., 124C and 124D of ring 124) allow each ring to be placed in its position in any particular way, right side up or right side down. So ring 121 may be placed on core 103 in the position shown in FIG. 11 (properly) or FIG. 10 (upside down). Each way works and serves to trigger the sensor 106 that the proper ring has been placed on the proper core segment.

Figure 11:
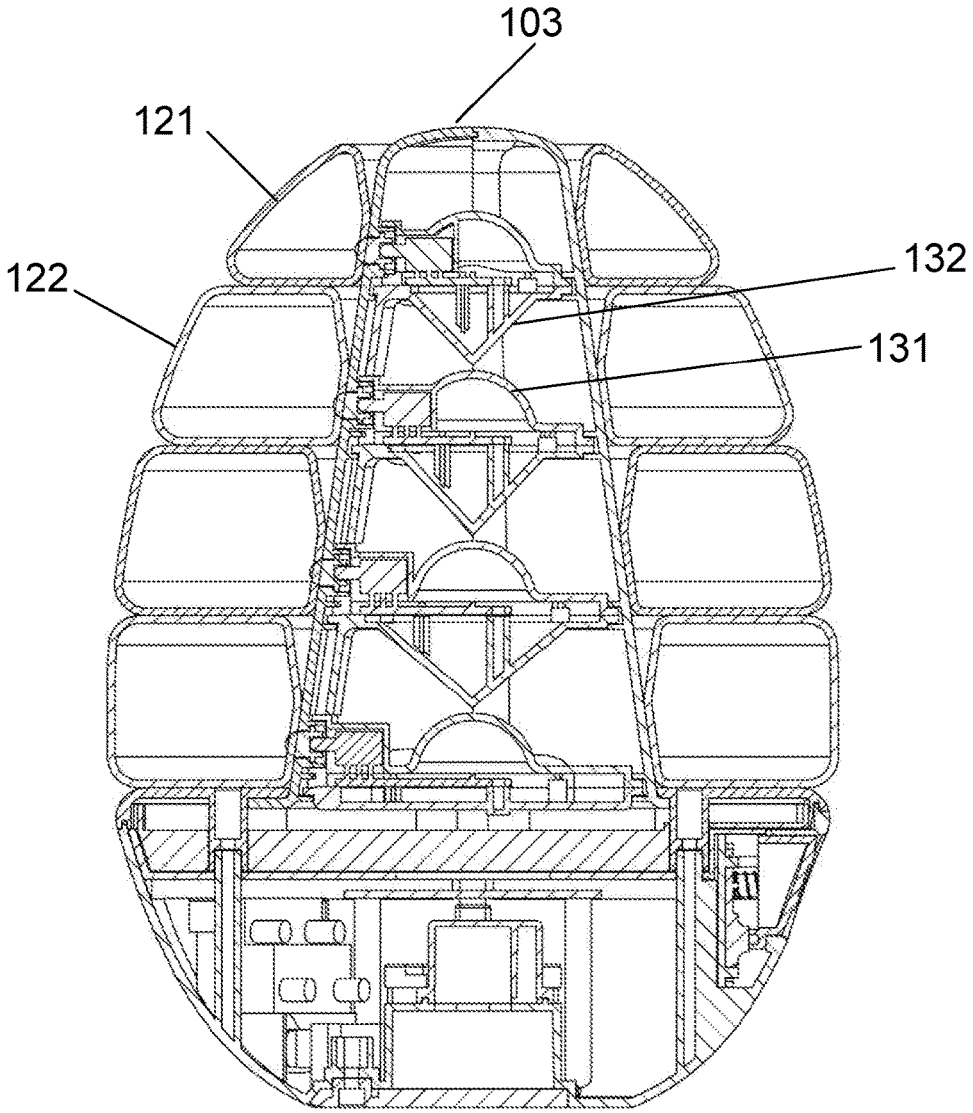
FIG. 11 illustrates a cross sectional view of an educational illumination stacker with rings, according to an exemplary embodiment of the present subject disclosure.
Figure 12:
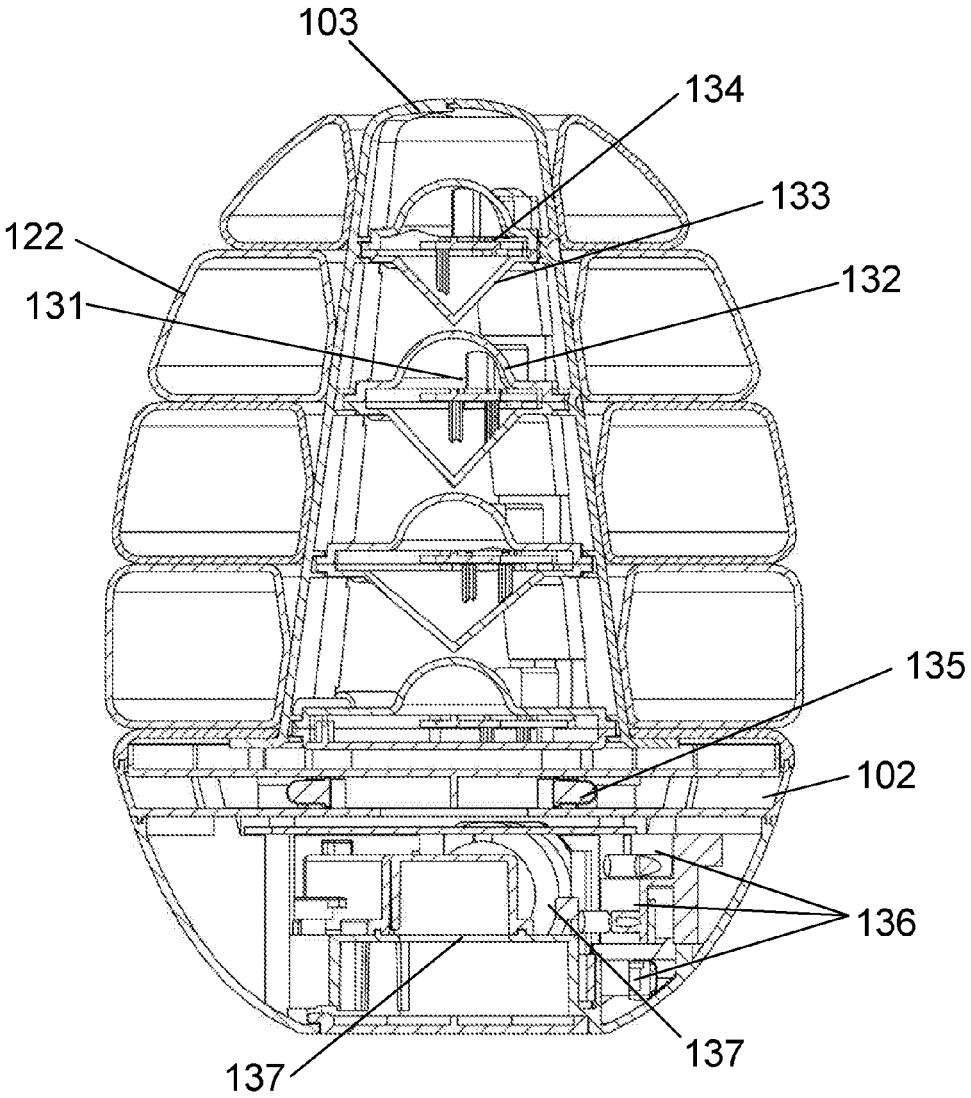
FIG. 12 illustrates another cross sectional view of an educational illumination stacker with rings, according to an exemplary embodiment of the present subject disclosure.

FIGS. 11-12 show two different cross sectional cuts through the device 100 in order to show the interior components. Of particular note are the LED lights which are stacked internally at each level. One example is shown for sake of simplicity but the cross sectional cuts shown in FIGS. 11-12 show the configuration at each segment 111, 112, 113, and 114. As shown in the figures a specifically colored light source 131, which can be an internal LED, is in the position of the core segment 112 corresponding to the color green. As LED 131 is lit with a green color, the light flows through a refractory dome 133 and then bounces off a triangular deflector 133 so that the light is directed through the body of ring 122. Because of the way the deflector 133 is positioned, the green light only illuminates through the portion of the core segment 112, which then, if the ring 122 is also in place on core segment 112, illuminates through ring 122. A circuit board 134 adjacent to each LED light 131 serves to control the electronic process. Standard LED lights 135 provide signals through the base window quarter lights 102. Internal switches that correspond to the buttons 104 control the various options as described elsewhere. The internal components 137 of speaker 105 are also shown. Finally, a battery compartment 138 houses one or more batteries used to generate power in the device 100. Although just a few items were pointed out in the figure, the same configuration applies to all of the lights within the core 103 that illuminate either through the core segments 111, 112, 113, and 114, or their corresponding rings, 121, 122, 123, and 124.

The center core 103 is molded from a translucent material to allow light to transmit through the wall so it can be seen on the outer surface. There is one LED 131 in each "level" or "section" of the center cone 103 which illuminates that location. The LED 131 is mounted on the bottom of each section and projected upward. At the top of each section is an inverted cone 133 with a reflective surface that transfers light from the bottom mounted LED 131 to the outside of the core 103 in a full 360 degrees. Each level on the centrally-located core 103 contains a push button switch 106 that detects when a ring is occupying that position. As described above, the core 103 is designed with a draft angle so that it is smallest diameter is at the top and its largest diameter is at its base. Because the diameter at each level varies it responds with the inner diameter of each ring. This ensures that each ring stops at its intended location on the core 103.

The rings are also molded from a translucent material which allows light transmission from the center core 103 to project through to the outer surface of each ring. The rings have a light matte texture to help diffuse the projected light to eliminate hot spots generated by the 4 LEDs located inside the core. The inner wall of each ring is designed so that it interfaces with the center core 103 in both upright and inverted orientations. When all rings are assembled in the upright position the overall shape of the product takes on that of an egg. This feature allows the child to assemble them in the proper location on the cone with no regard to an upright or inverted orientation.

There are 4 quadrants in the base 101 that illuminate from LEDs mounted inside the unit. The LEDs are located near the center vertical axis of the device 100 which allows for maximum range of light illumination. Each quadrant contains a translucent window that allows light to transmit through to its outer surface. The base 101 houses the power button 108 which is also molded with a translucent material. This allows light to transmit through it which is generated from the LED mounted behind it.

Overall, the device 100 can have numerous areas of illumination. In the examples shown, the device 100 has 9 areas of illumination, 4 circular ringed core segments 111, 112, 113, and 114 on the center core 103, and 4 in the base windows 102A, 102B, 102C, and 102D, and 1 behind the Power Button 108. The LEDs on the center core 103 are stacked vertically with each LED representing a dedicated color that corresponds to the ring that fits that specific position. The position of the colored rings is yellow at the top position (core segment 111), green at the $2^{nd}$ position from the top (core segment 112), pink at the $3^{rd}$ position from the top (core segment 113), and blue at the bottommost position (core segment 114). Therefore, the LEDs 131 from top to bottom are yellow, green, pink and blue. The LED located behind the Power Button is blue in color.

The LEDs on the base 101 correspond to the same 4 colors as the LEDs on the center core—yellow, green, pink and blue. The LEDs on the base 101 are arranged into 4 quadrants 102A, 102B, 102C, and 102D with each quadrant representing a 90 degree section around the circular base 101. These LEDs are located as close to the center of the device 100, away from the lens/diffuser 132, to create the most consistent illumination effect without hot spots.

The device 100 may have numerous sound effects. In one exemplary embodiment, the device 100 has approximately 8 sound effects (SFX) which are sounded when the unit is turned on, shutting down, when rings are placed on the center cone 103 and when all rings are assembled properly. Any other combination is also possible.

To turn the device 100 on, the user must press the Power button 108. If the power button 108 is pressed and held for more than 3 seconds the device 100 will not turn on. This press and hold disabling feature is to prevent accidental activation when the device 100 is placed in a toy bin. The user presses the power button 108 to turn the unit on and the power button 108 illuminates through the start-up sequence and throughout the entire duration of the game.

Figure 13:
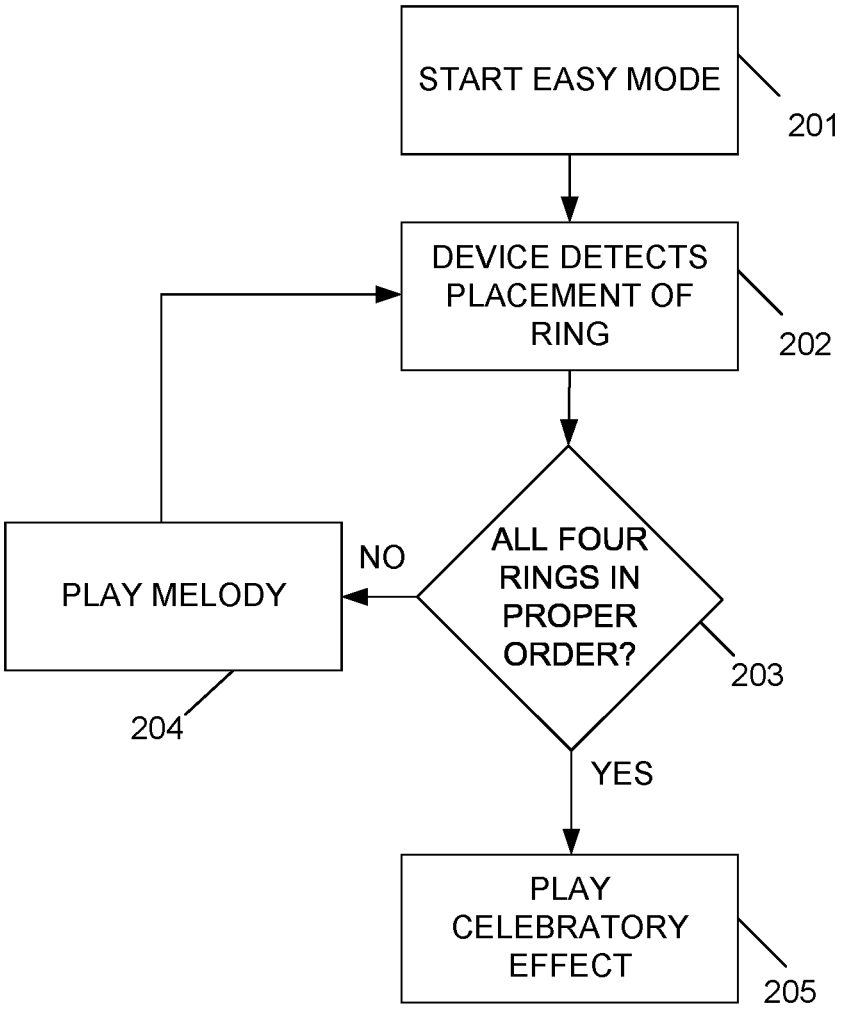
FIG. 13 illustrates a flow diagram of an easy level game on the illumination stacker device, according to an exemplary embodiment of the present subject disclosure.

The device 100 may operate a number of different types of games, which may be classified as easy, intermediate, or difficult. The general direction of easy mode is to allow the user to position rings in any order on the core and receive positive feedback in the form of lights, sound and voice sound effects. No negative sound effects are played because there is no "right" or "wrong" way to assemble them. If the user does happen to assemble all rings in the proper location then they are rewarded with a celebratory effect. As shown in FIG. 13, to start easy mode, the user must press the power button with the mode switch in the easy mode position or move it to the easy mode position, as shown in step 201. Next the device 100 detects whether a ring has been placed on the core, at step 202. Upon detection of any ring, the device determines if all four rings have been properly placed on the core, at step 203. If the four rings have not been detected, then the device plays a short positive melody at step 204, and awaits any further placement of rings. If the four rings have been placed in the proper order at step 203, then the device proceeds to step 205 and plays a celebratory effect, which could be a combination of lights, sounds and voices which indicate a celebration. These could include sounds of fireworks, a voice indicating "congratulations" or "good job" and an extended melody signifying successful completion of the game. The user can then remove the rings and start over or proceed to a more advanced game.

Figure 14:
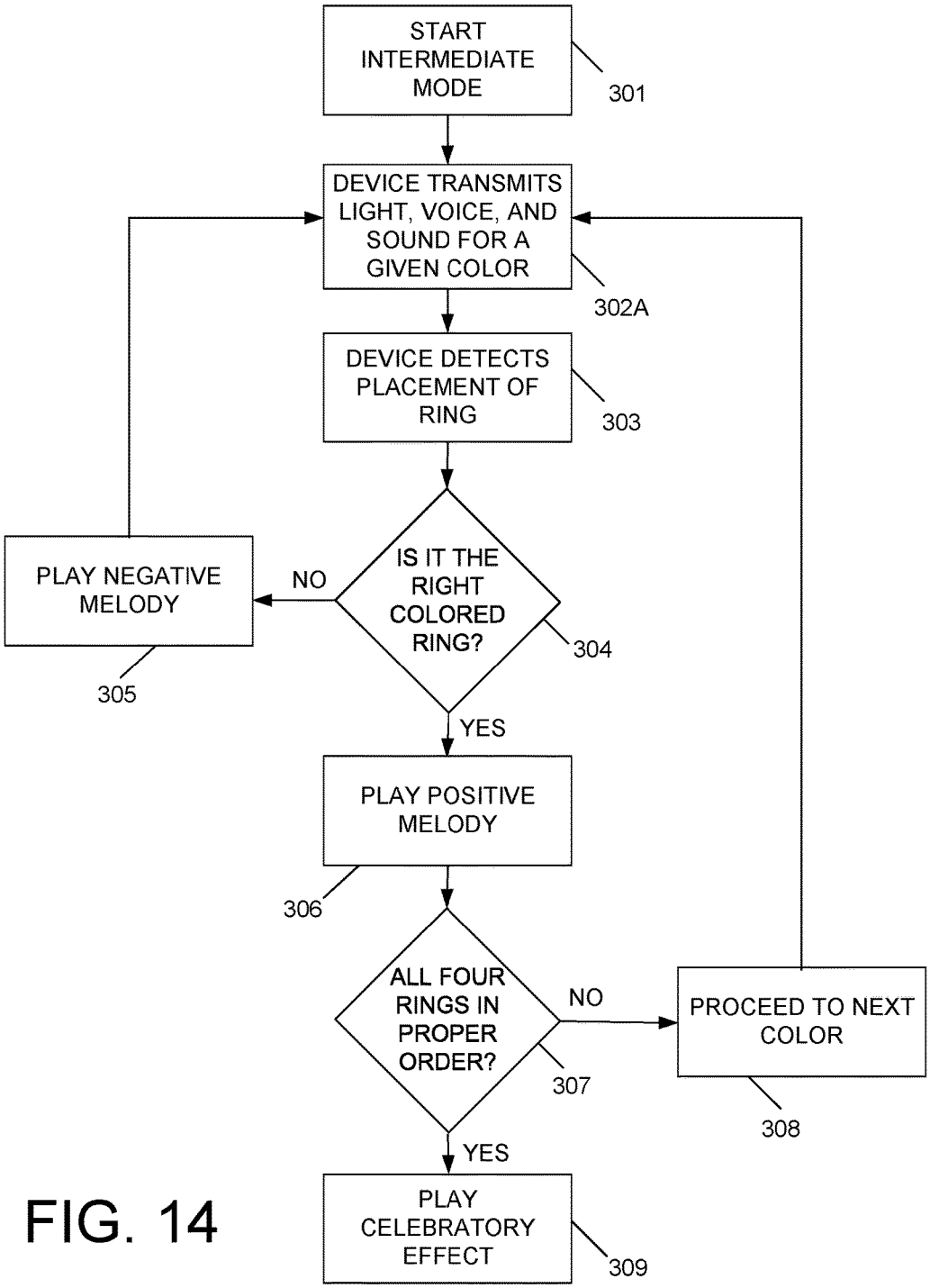
FIG. 14 illustrates a flow diagram of an intermediate level game on the illumination stacker device, according to an exemplary embodiment of the present subject disclosure.

The device may be operated with an intermediate level game. The general direction of intermediate mode is to prompt the user, using lights, voice and sound, to assemble the rings in a specific order, from the bottom up (blue, pink, green, yellow). If they do this correctly then they get a celebratory effect, but if they do it incorrectly they get a negative response. As shown in FIG. 14, a user starts the intermediate mode at step 301. Next, the device transmits colored light, voice and sounds to indicate a request for a given color, e.g., blue, at step 302A. Upon placement of a ring on the central core, at step 303, the device determines whether the correct ring was placed in response to the device request, at step 304. If the incorrect ring was placed on the core in response to a given color request, then the device plays a negative tone or sound at step 305, and repeats the request for the given color at step 302A. This process is continued until the right colored ring is placed on the core at step 304, at which the device plays a positive melody at step 306 and then determines if all four rings have been placed in proper order on the core, at step 307. If all four rings have not been placed in order, then the device proceeds to step 308 which takes it back to request the next color at step 302A. The 304-305-302A loop (wrong colored ring) and 304-306-307-308-302A loop (right colored ring) are repeated until all four rings are placed in the proper color order, namely blue, then pink, then green, then yellow. When all four colored rings have been placed in the proper order, as determined at step 307, then the device proceeds to step 309 and plays a celebratory effect, which could be a combination of lights, sounds and voices which indicate a celebration. These could include sounds of fireworks, a voice indicating "congratulations" or "good job" and an extended melody signifying successful completion of the game. The user can then remove the rings and start over or proceed to a less or more advanced game.

Figure 15:
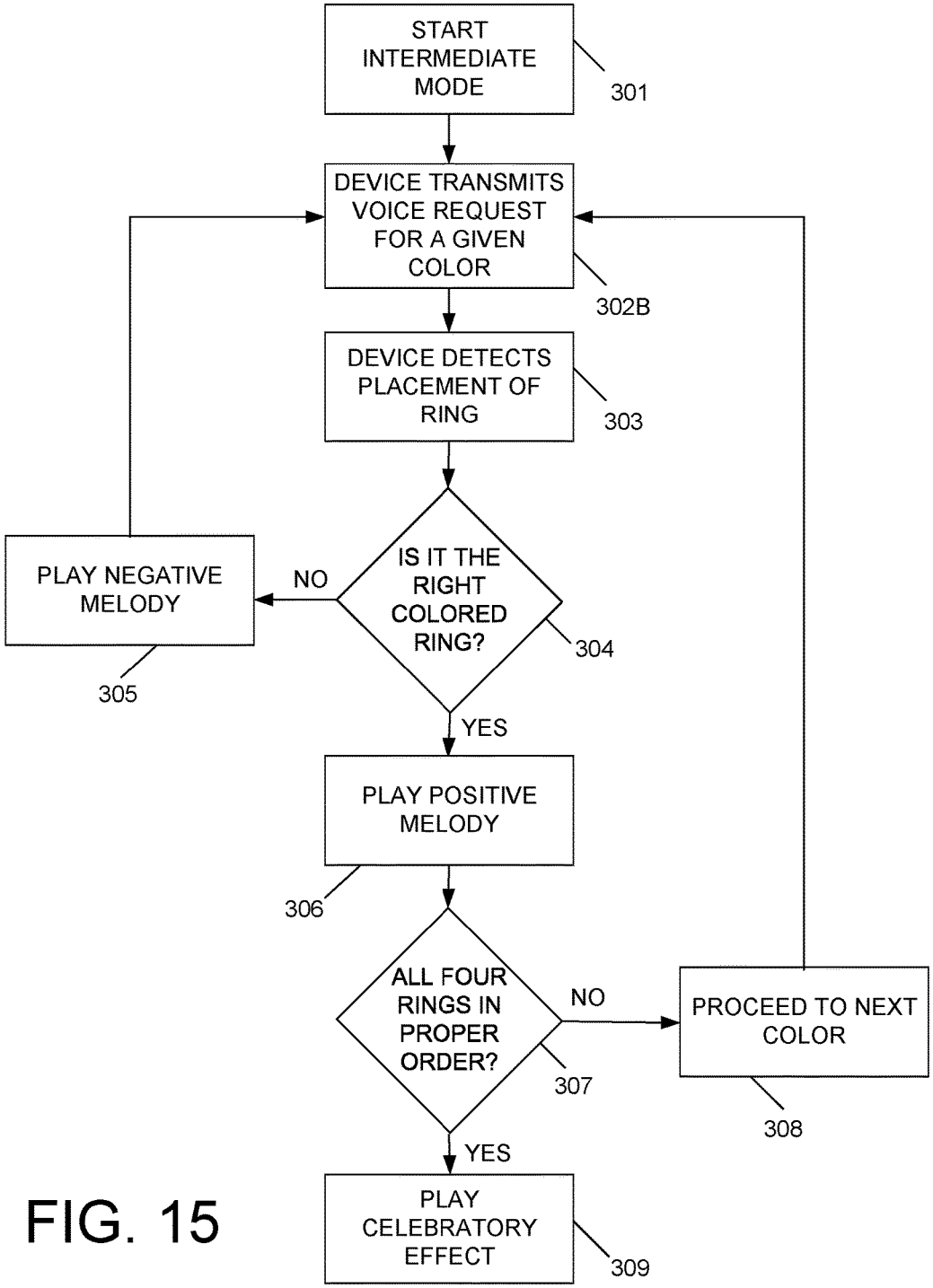
FIG. 15 illustrates a flow diagram of an advanced level game on the illumination stacker device, according to an exemplary embodiment of the present subject disclosure.

One example of an advanced mode game is to prompt the user to position rings on the core using only voice prompts. This is to help the child associate the color of the rings with the color as a spoken word, i.e., blue. When assembled in the proper order they will receive positive feedback in the form of lights, sound and voice effects, but when assembled incorrectly they receive negative feedback. As shown in FIG. 15, the process for the advanced game is essentially the same as that described in FIG. 14 for the intermediate game. However, the main difference is that at step 302B, the advanced process only transmits a voice request for a color ("blue") without the additional flashing lights and sounds. This will allow the child to learn to associate the spoken word for a color with the given color without visual cues to the color being requested. The process proceeds as described with respect to FIG. 14 and will not be repeated here.

Finally, as discussed above, there is a "try me" mode. This mode is only applicable to the product on the retail shelf and is activated by the power button on the front. Once the product has been removed from the package there will be a removable pull tab protruding from the battery door. It will say "remove to use". Once removed the TRY-ME mode is deactivated. When Try-Me mode is active and the Power Button is pushed it initiates Try-Me mode and the power button illuminates for entire duration of Try-Me mode.

No matter which mode is being used (easy, intermediate, advanced), the device goes through a shut-down sequence if there is no interaction for a continuous 40 second duration. This sequence consists of lights and sounds to alert the user that it's about to shut down.

As defined herein and throughout this disclosure and claims, the term "audiovisual" is either an audio or a video signal or a combination thereof.

The illustrations and examples provided herein are for explanatory purposes and are not intended to limit the scope of the appended claims. It will be recognized by those skilled in the art that changes or modifications may be made to the above described embodiment without departing from the broad inventive concepts of the subject disclosure. It is understood therefore that the subject disclosure is not limited to the particular embodiment which is described, but is intended to cover all modifications and changes within the scope and spirit of the subject disclosure.

What is claimed is:

1. A feedback stacker comprising:

a plurality of rings;

a base;

a cylindrical core extending in a perpendicular direction away from the base;

a plurality of segments on the core, each segment including a sensor for detecting the presence of a corresponding ring;

an audiovisual alert signal that signifies whether a correct ring is positioned on the cylindrical core in response to an audiovisual request signal; and a different colored visual indicator at each of the segments on the core, wherein the audiovisual request signal comprises illumination of one of the colored visual indicators and a voice command for a specific color.

2. The feedback stacker of claim 1, wherein the diameter of the core decreases as it extends away from the base.

3. The feedback stacker of claim 1, wherein each ring in the plurality of rings has a central aperture with a different diameter.

4. The feedback stacker of claim 1, wherein the central aperture of each ring comprises two wall portions which connect at a pointed center point.

5. The feedback stacker of claim 1, wherein each of the plurality of segments corresponds to a different diameter of the core.

6. The feedback stacker of claim 1, wherein each ring has a beveled edge to make it easier to separate the ring from adjacent rings.

7. The feedback stacker of claim 1, wherein the audiovisual alert signal comprises a positive signal when a correct ring is positioned in response to the audiovisual request signal.

8. The feedback stacker of claim 1, further comprising a switch to select the type of audiovisual request signal to be used.

9. A feedback stacker comprising;

a plurality of rings;

a base;

a cylindrical core extending in a perpendicular direction away from the base;

a plurality of segments on the core, each segment including a sensor for detecting the presence of a corresponding ring; and an audiovisual alert signal that signifies whether a correct ring is positioned on the cylindrical core in response to an audiovisual request signal, wherein the audiovisual alert signal comprises a negative signal when an incorrect ring is positioned in response to the audiovisual request signal.

10. A feedback stacker comprising:

a plurality of rings having center apertures of different diameters;

a base;

a cylindrical core extending in a perpendicular direction away from the base;

a plurality of segments on the core, each segment including a different colored visual indicator, and a sensor for detecting the presence of a corresponding ring; and an audiovisual alert signal that signifies whether a correct ring is positioned on the cylindrical core in response to an audiovisual request signal, wherein the audiovisual alert signal indicates a negative signal when an incorrect ring is positioned in response to the audiovisual request signal.

11. A method of playing stacker comprising:

providing a base with a cylindrical core having sensors thereon to determine rings placed thereon;

signaling a first audiovisual request signal indicating a first requested color;

receiving a first ring on the cylindrical core;

determining if the first ring has a color that matches the first requested color; and providing an alert that indicates whether the first ring matches the first requested color, wherein the alert indicates a negative tone if the first ring has a color that does not match the first requested color.

12. The method of claim 11, wherein the alert indicates a positive tone if the first ring has a color that matches the first requested color.

13. The method of claim 11, wherein the audiovisual signal is a colored light.

14. A method of playing stacker comprising:

providing a base with a cylindrical core having sensors thereon to determine rings placed thereon;

signaling a first audiovisual request signal indicating a first requested color;

receiving a first ring on the cylindrical core;

determining if the first ring has a color that matches the first requested color; and providing an alert that indicates whether the first ring matches the first requested color, wherein if the first ring has a color that matches the first requested color, then signaling a second audiovisual request signal indicating a second requested color.

15. A method of playing stacker comprising:

providing a base with a cylindrical core having sensors thereon to determine rings placed thereon;

signaling a first audiovisual request signal indicating a first requested color;

receiving a first ring on the cylindrical core;

determining if the first ring has a color that matches the first requested color; and providing an alert that indicates whether the first ring matches the first requested color, wherein the audiovisual signal is a voice command.

* * * * *